US008910915B2

(12) United States Patent
Wibby et al.

(10) Patent No.: US 8,910,915 B2
(45) Date of Patent: Dec. 16, 2014

(54) FOLDING STAND AND COVER

(75) Inventors: Adam Wibby, Fort Collins, CO (US); Alan Morine, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 13/218,676

(22) Filed: Aug. 26, 2011

(65) Prior Publication Data

US 2012/0325689 A1 Dec. 27, 2012

Related U.S. Application Data

(63) Continuation-in-part of application No. 29/394,722, filed on Jun. 21, 2011, now abandoned.

(51) Int. Cl.

| | |
|---|---|
| ***A47B 23/04*** | (2006.01) |
| ***B65D 81/36*** | (2006.01) |
| ***B65D 25/00*** | (2006.01) |
| ***B65D 5/52*** | (2006.01) |
| ***B65D 85/38*** | (2006.01) |

(52) U.S. Cl.

CPC ..... *A47B 23/043* (2013.01); *B65D 2585/86* (2013.01); *B65D 81/368* (2013.01); *B65D 25/00* (2013.01); *B65D 5/52* (2013.01); *B65D 85/38* (2013.01)

USPC ..... 248/460; 248/450; 248/459; 206/45.2

(58) Field of Classification Search

CPC ..... A47B 23/043

USPC ..... 248/441.1, 444, 450, 454, 455, 456, 248/459, 371, 346.03, 346.06, 451, 453, 248/460; 211/42, 43, 72; 361/679.01–679.02, 679.55, 679.59; 40/722–724, 750; 206/45.2, 45.23, 206/45.24, 320; D14/447

See application file for complete search history.

(56) References Cited

U.S. PATENT DOCUMENTS

| | | | | | |
|---|---|---|---|---|---|
| 3,410,516 | A * | 11/1968 | Criswell | ..... | 248/459 |
| 3,447,770 | A * | 6/1969 | Gallamos | ..... | 248/453 |
| 3,460,795 | A * | 8/1969 | Dahlin | ..... | 248/452 |
| 4,460,146 | A * | 7/1984 | Raggiotti | ..... | 248/456 |
| 4,674,724 | A * | 6/1987 | Gaudet | ..... | 248/459 |
| 5,607,135 | A * | 3/1997 | Yamada | ..... | 248/456 |
| 6,082,696 | A * | 7/2000 | Patterson | ..... | 248/454 |
| 6,523,858 | B2 * | 2/2003 | Takemura | ..... | 281/29 |
| 6,557,897 | B1 * | 5/2003 | Gaudet | ..... | 281/33 |
| 6,568,543 | B1 * | 5/2003 | Schneider | ..... | 211/43 |
| 6,672,549 | B2 | 1/2004 | Kolb | | |
| 6,729,518 | B2 | 5/2004 | Badillo et al. | | |
| 6,967,836 | B2 * | 11/2005 | Huang et al. | ..... | 361/679.46 |
| 7,270,255 | B2 | 9/2007 | Badillo et al. | | |

(Continued)

*Primary Examiner* — Jonathan Liu
*Assistant Examiner* — Guang H Guan

(57) ABSTRACT

A folding stand may attach to an electronic device for transportation in one configuration and may fold into a second configuration to hold the electronic device for use. The folding stand may have two main rigid components that are joined by a hinge. Each of the rigid components may have engagement mechanisms that clamp onto the electronic device in the first configuration and hold the device in one of several upright positions in the second configuration. A stringer may be attached to one of the rigid components with a hinge and may engage the other rigid component with a snap or other mechanism. In some embodiments, the entire stand may be a single piece manufactured from rigid plastic components joined with a second, flexible material that may provide one or more of the hinges in the stand.

20 Claims, 7 Drawing Sheets

(56) References Cited

U.S. PATENT DOCUMENTS

| | | | | |
|---|---|---|---|---|
| 7,318,521 | B2 | 1/2008 | Lau | |
| 7,597,225 | B2 | 10/2009 | Badillo et al. | |
| 7,735,644 | B2 * | 6/2010 | Sirichai et al. | 206/320 |
| D626,964 | S * | 11/2010 | Richardson et al. | D14/447 |
| 7,861,995 | B2 | 1/2011 | Liou | |
| 8,100,376 | B2 * | 1/2012 | Ye | 248/454 |
| 8,281,924 | B2 * | 10/2012 | Westrup | 206/320 |
| 8,424,829 | B2 * | 4/2013 | Lu et al. | 248/371 |
| 8,424,830 | B2 * | 4/2013 | Yang et al. | 248/459 |
| 8,434,601 | B2 * | 5/2013 | Hou et al. | 190/1 |
| 8,464,995 | B2 * | 6/2013 | Yang et al. | 248/455 |
| 8,474,609 | B1 * | 7/2013 | Hong et al. | 206/45.2 |
| 8,544,639 | B2 * | 10/2013 | Yang et al. | 206/45.2 |
| 8,640,864 | B2 * | 2/2014 | Chen et al. | 206/45.2 |
| 8,714,510 | B2 * | 5/2014 | McCosh et al. | 248/460 |
| 2007/0211420 | A1 | 9/2007 | Bang | |
| 2009/0171224 | A1 * | 7/2009 | Jochim et al. | 600/501 |
| 2010/0072334 | A1 | 3/2010 | Le Gette et al. | |
| 2010/0090085 | A1 * | 4/2010 | Corrion | 248/459 |
| 2010/0213331 | A1 | 8/2010 | Liou | |
| 2011/0103032 | A1 | 5/2011 | Loi et al. | |
| 2011/0253850 | A1 | 10/2011 | Bau | |
| 2011/0260014 | A1 * | 10/2011 | Chen | 248/157 |
| 2012/0008300 | A1 * | 1/2012 | Ladouceur et al. | 361/807 |
| 2012/0146466 | A1 * | 6/2012 | Lu et al. | 312/223.1 |
| 2012/0325689 | A1 * | 12/2012 | Wibby et al. | 206/45.2 |

* cited by examiner

FOLDING STAND AND COVER

This application claims the benefit of and priority to U.S. patent application Ser. No. 29/394,722, filed 21 Jun. 2011, the entire contents of which are hereby expressly incorporated by reference for all it discloses and teaches.

BACKGROUND

Tablet computers and other touchscreen devices are often high value and heavily used devices. These devices often have a touchscreen by which a user may interact with the device's operating system and applications.

SUMMARY

A folding stand may attach to an electronic device for transportation in one configuration and may fold into a second configuration to hold the electronic device for use. The folding stand may have two main rigid components that are joined by a hinge. Each of the rigid components may have engagement mechanisms that clamp onto the electronic device in the first configuration and hold the device in one of several upright positions in the second configuration. A stringer may be attached to one of the rigid components with a hinge and may engage the other rigid component with a snap or other mechanism. In some embodiments, the entire stand may be a single piece manufactured from rigid plastic components joined with a second, flexible material that may provide one or more of the hinges in the stand.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

A cover for a device may be foldable into a stand. The cover may mount to the device by capturing the device on several sides or corners, but may be folded into a stand that may support the device in a landscape or portrait orientation. Some embodiments may be capable of supporting the device in a high and low angle orientation in both landscape and portrait orientations.

The folding cover may operate in conjunction with a second cover that attaches to the device. The second cover may engage the device on several sides, yet the folding cover may snap or otherwise engage the second cover to provide protection over a portion of the device. In such an embodiment, the folding cover may clip, snap, or otherwise removably attach to the second cover.

The folding cover may operate with a tablet or slate computing device. The device may have a large touchscreen, and some devices may include a keyboard as well.

The folding cover may be manufactured from two different material types. A rigid material type may be used for the various components, with a flexible material type used to join the rigid components together. In some embodiments, the flexible material type may be overmolded onto the rigid components to form a single piece cover that flexes at various hinge points.

The cover may fold into a stand that may support the device. In the folded condition, a stringer and a lock plate may be folded in an opposite direction from the main rigid components. The lock plate may have a locking feature that locks to one of the main rigid components to keep the cover in the folded position.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

Figure 1:
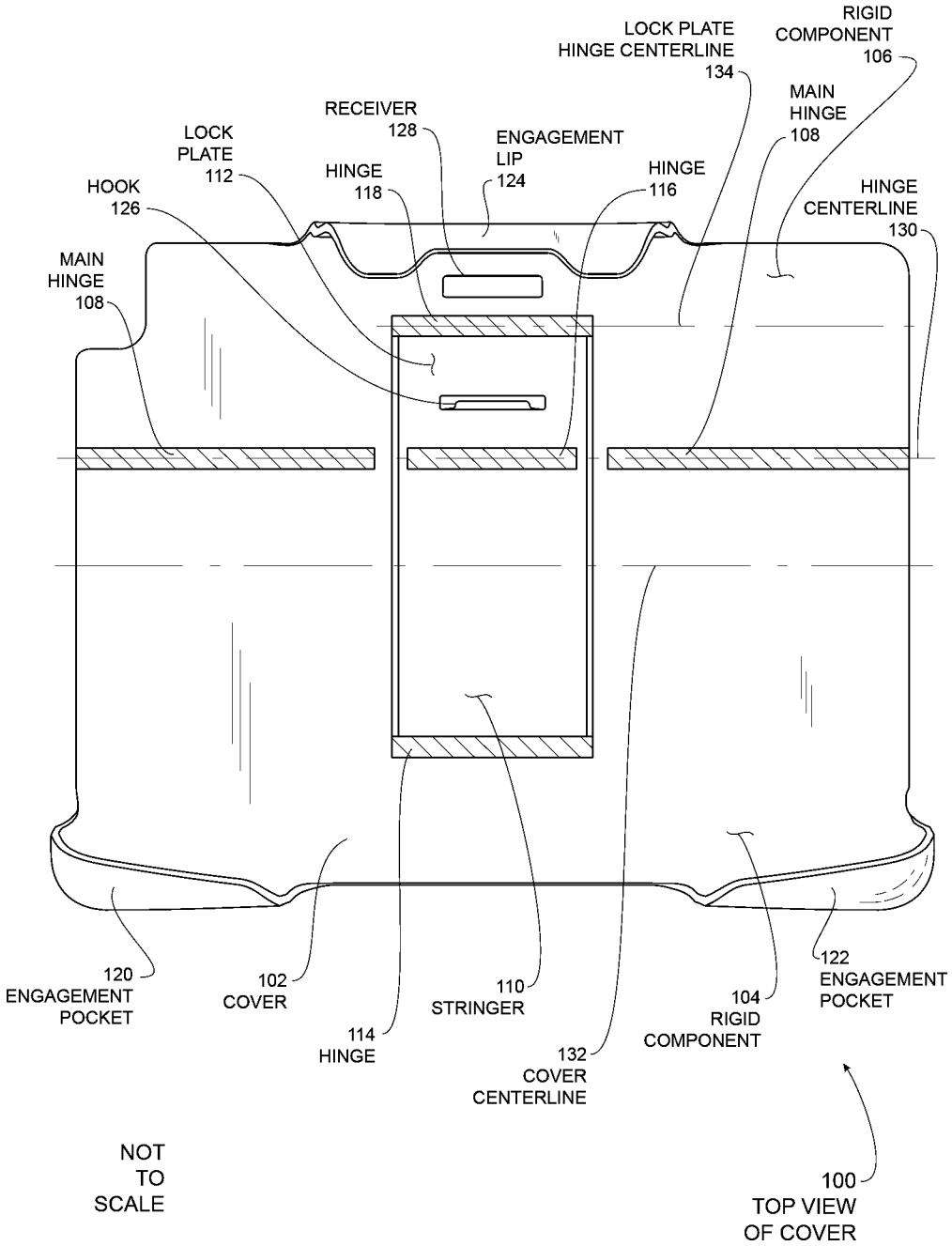
FIG. 1 is an illustration of an embodiment showing a top view of a foldable protective cover.

FIG. 1 is a top view illustration of an embodiment 100, showing a folding stand and cover. FIG. 1 is not to scale. Embodiment 100 illustrates an example of a protective case that may be removed from a device, then folded into a stand for the device.

Embodiment 100 illustrates a cover that may protect a device when the device is not in use. A typical electronic device for which the cover may be used may be a tablet or slate computer. Many such devices may have a touchscreen that may occupy a large portion of the body of the device. Some such devices may have one or more additional keys or buttons on the front, sides, or rear of the device. Some devices may also have cameras mounted on the front or back of the device, as well as speakers, microphones, accessory devices, charging receptacles, electronic interface receptacles, or other interface connections.

The devices may include various media readers, such as book readers, as well as game consoles, touch screen interfaces for automation systems, non-touchscreen display devices, or other devices. In many cases, the devices may be predominately flat and thin, although other devices may have curvature or other shapes.

The cover 102 may be attached over the display portion of the device when assembled onto the device in a protective position. Some embodiments may also have a storage position where the cover 102 may be attached over the rear of the device so that the user may use the device while keeping the cover 102 attached to the device.

The cover 102 may be a one piece cover that may be manufactured from several rigid components that are joined by flexible hinges. In a typical manufacturing process, the rigid components may be manufactured first, then overmolded with a flexible material to join the components together. In some instances, the rigid components and flexible material may be manufactured using a two-shot molding process.

The various rigid materials may be manufactured from any suitable material, which may be metal, plastic, or other material. In many embodiments, the rigid components may be molded thermoplastic parts, such as nylon, polystyrene, polycarbonate, polyvinylchloride, polypropylene, acrylonitrile-butadiene-styrene, polyurethane, or other plastics. Some embodiments may use reinforcements, which may be glass fibers, carbon fibers, metal fibers, polyamide fibers, or other reinforcements. Some embodiments may use fillers, such as hollow glass beads, entrapped air, or other filler materials that may reduce the weight of the product. Some embodiments may use weighted fillers, such as ceramic or other fillers that may add weight to the product.

The flexible material may be a thermoplastic polymerized rubber that may be molded onto the rigid components. Other embodiments may use a moldable silicone or other material.

In some embodiments, the cover 102 may be manufactured from a single material. In the flexible areas, the material may be a thin cross section so that the material may flex, and the rigid areas may have a thicker cross section where the material may not flex or not flex as much as the thin areas.

The cover 102 may be constructed from rigid components 104 and 106, which may be joined by a hinge 108. The rigid components 104 and 106 in many embodiments may be the largest portions of the cover 102 and may cover much of a device when the cover 102 may be attached in a protective position.

A stringer 110 and a lock plate 112 may be joined together with a hinge 116. The stringer 110 may be joined to the rigid component 104 with a hinge 114, and the lock plate 112 may be joined to the rigid component 106 with the hinge 118.

When the hinge 108 is folded in one direction and the hinge 116 is folded in the opposite direction, the lock plate 112 may engage the rigid component 106 and provide a stand for displaying and using the device. The lock plate 112 may have a hook 126 that may engage a receiver 128 to lock the stand in a folded position.

The device may be held in place in a protective position by engaging the engagement pockets 120 and 122, as well as the engagement lip 124. In some embodiments, the engagement lip 124 may be a rigid feature and the engagement pockets 120 and 122 may be flexible features. In such embodiments, an electronic device may be slipped into the engagement lip 124 and the engagement pockets 120 and 122 may be folded over the corners of the device. The cover 102 may be removed by the reverse process.

In some embodiments, the engagement pockets 120 and 122 may be rigid features and the engagement lip 124 may also be rigid. In such embodiments, the flexible material forming the main hinge 108 may be stretchable enough to allow a user to stretch the cover 102 to engage the device. In some such embodiments, the cover 102 may attach with a snap onto the device.

In still other embodiments, the engagement lip 124 may be a movable feature that may rotate over the device and snap into place.

The centerline 130 of the main hinge 108 may be offset from the centerline 132 of the cover 102. The offset of the main hinge 108 may create a folding stand that has two different angles to support the device.

Embodiment 100 shows the main hinge centerline 130 as being parallel to the longest side of the cover 102. The longest side of the cover 102 may be considered a horizontal landscape axis. Other embodiments may be oriented such that the main hinge centerline 130 is parallel to the shortest side of the cover 102. The shortest side of the cover 102 may be considered the horizontal portrait axis.

The hinge 118 may have a lock plate hinge centerline 134. The lock plate hinge centerline 134 may be closer to the main hinge centerline 130 than the top edge of the cover 102, as seen in the embodiment 100.

The hinge 116 may have a centerline that is coaxial with the main hinge centerline 130 when the cover 102 is flat. In some embodiments, the hinge 116 may be located parallel to but offset from the main hinge centerline 130.

In many embodiments, the various hinges may be formed so that the hinges naturally bend in a particular direction. In such embodiments, the bend of hinge 116 may be opposite of the main hinge 108.

Figure 2:
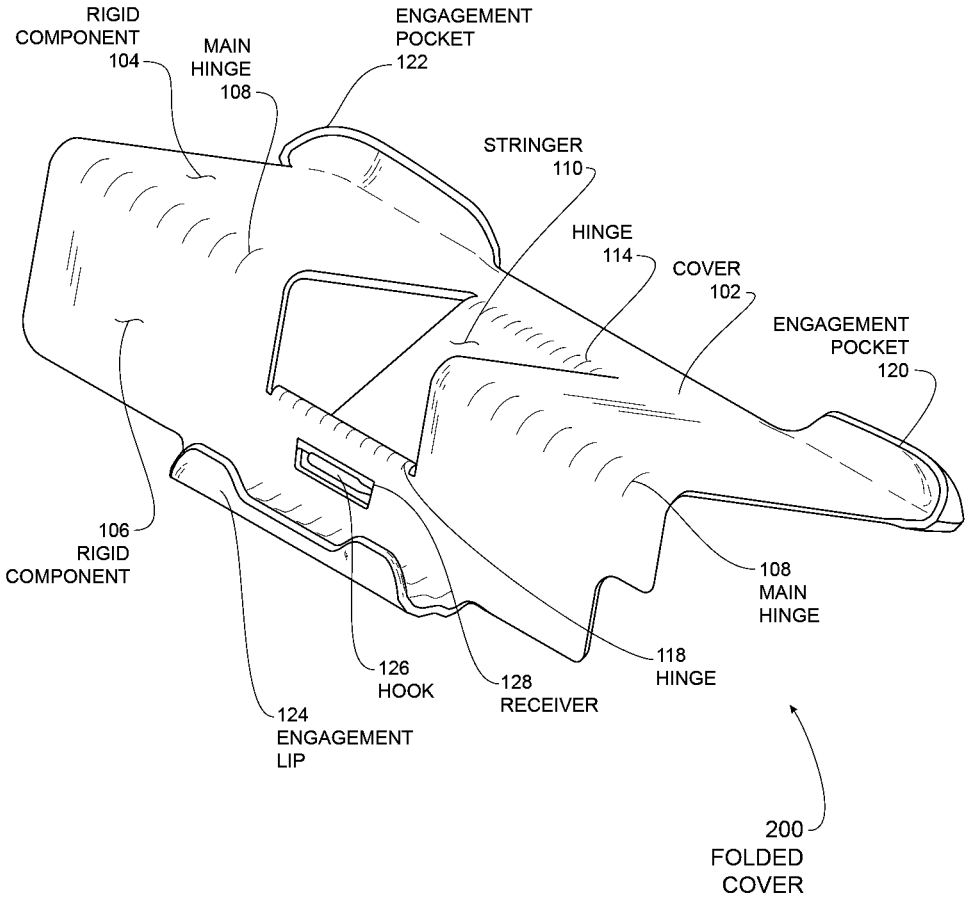
FIG. 2 is an isometric illustration of an embodiment of a folded protective cover shown in the folded position.

FIG. 2 is an isometric view illustration of an embodiment 200, showing the cover 102 in a folded position. FIG. 2 is not to scale. Embodiment 200 illustrates an example of a protective case that may be removed from a device, then folded into a stand for the device.

Embodiment 200 illustrates the cover of embodiment 100 in a folded and locked position. From the folded and locked position, a device may be supported in either a landscape or portrait orientation in either of two supported angles.

The rigid components 104 and 106 are joined by hinge 108. The stringer 110 is illustrated as being attached by hinge 114. The lock plate is hidden from view, but the hinge 118 is shown. The hook 126 attached to the lock plate is shown engaged with the receiver 128.

The lock plate with its hook 126 and the receiver 128 on the rigid component 106 may be one form of removably attachable mechanism that may connect the stringer 110 with the rigid component 106.

In other embodiments, the stringer 110 may have a clip, hook, or other mechanism that may engage the rigid component 106. In such embodiments, the end of the stringer 110 at hinge 116 may contain the engagement mechanism. One such embodiment may have a flap on which one portion of a hook and look fastening system may be placed. The mating portion of the hook and loop fastening system may be mounted on the rigid component 106.

The folded orientation of the cover 102 may allow a device to be propped up or captured by either the engagement lip 124 or the engagement pockets 120 and 122. The engagement lip 124 and the engagement pockets 120 and 122 may be sized so that the device may be captured in either the landscape or portrait orientations.

In the folded position, the hinge 108 may flex in the opposite direction of the hinge 116. Hinge 116 is not illustrated in embodiment 200, but joins the stringer 110 and the lock plate 112. When the lock plate engages and locks to the rigid component 106, the cover 102 may be rigid enough to support the device during use.

Figure 3:
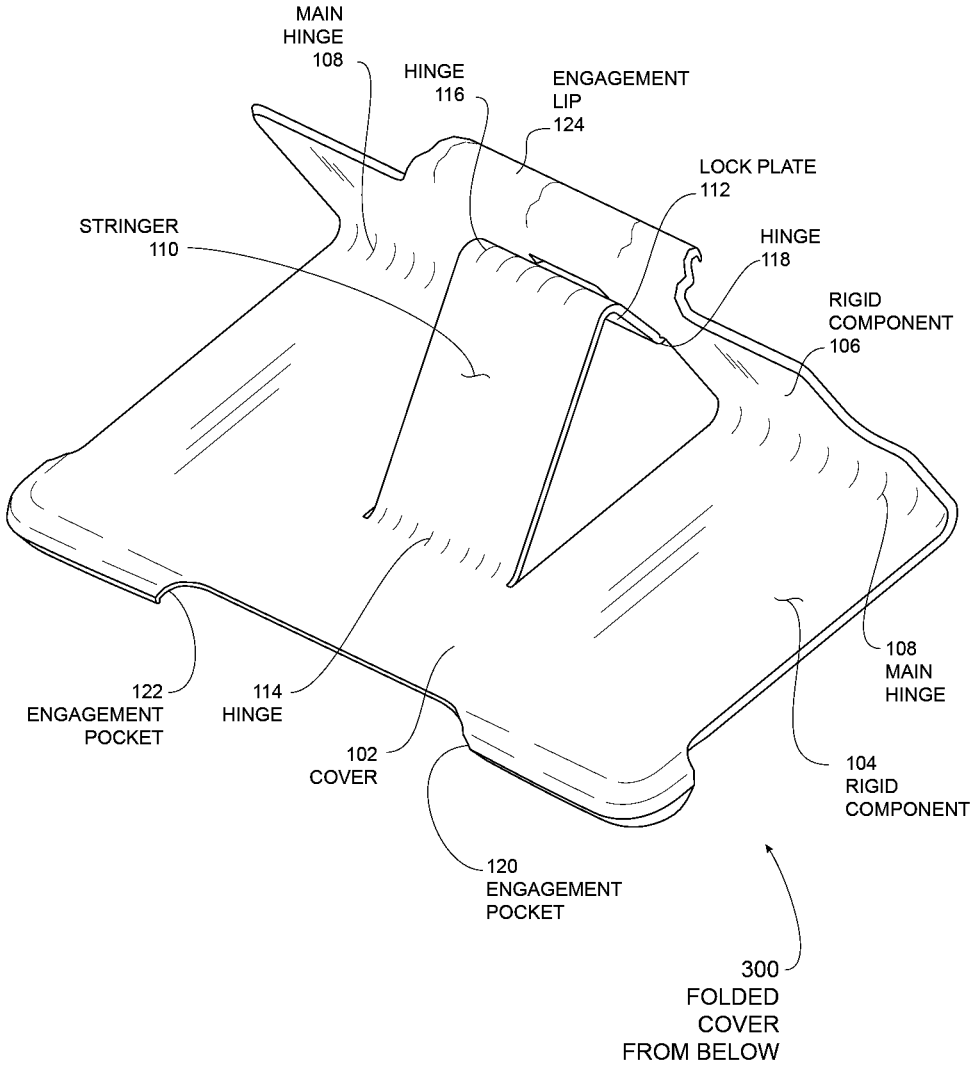
FIG. 3 is an isometric illustration of an embodiment of a folded protective cover shown in the folded position from the bottom.

FIG. 3 is an isometric view illustration of an embodiment 300, showing the cover 102 in a folded position as viewed from the bottom. FIG. 3 is not to scale. Embodiment 300 illustrates an example of a protective case that may be removed from a device, then folded into a stand for the device.

Embodiment 300 illustrates the cover of embodiment 100 in a folded and locked position. The rigid components 104 and 106 are joined by hinge 108. The stringer 110 is illustrated as being attached by hinge 114. The lock plate 112 is joined by hinges 116 and 118. The lock plate 112 is shown as engaged to the rigid component 106.

In the orientation of embodiment 300, the engagement pockets 120 and 122 and engagement lip 124 are shown from the bottom.

Figure 4:
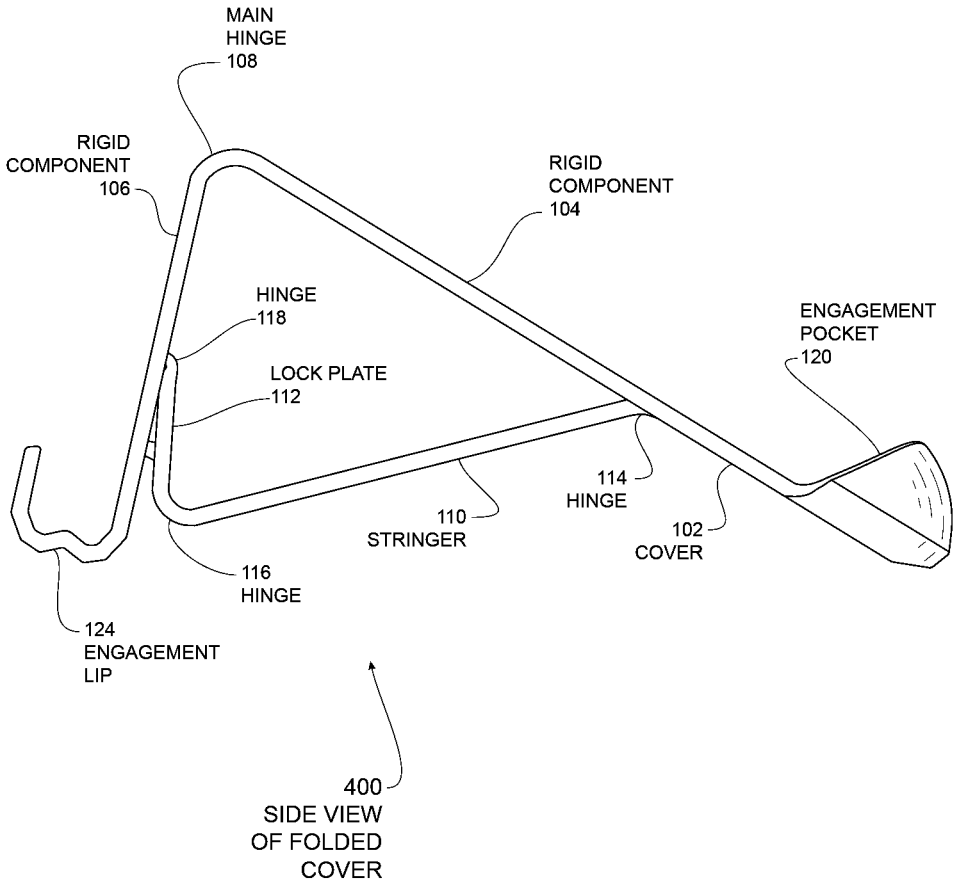
FIG. 4 is a side view of an embodiment of a folded protective cover shown in the folded position.

FIG. 4 is a side view illustration of an embodiment 400, showing the cover 102 in a folded position. FIG. 4 is not to scale. Embodiment 400 illustrates an example of a protective case that may be removed from a device, then folded into a stand for the device.

Embodiment 400 illustrates the cover of embodiment 100 in a folded and locked position. The rigid components 104 and 106 are joined by hinge 108. The stringer 110 is illustrated as being attached by hinge 114. The lock plate 112 is joined by hinges 116 and 118. The lock plate 112 is shown as engaged to the rigid component 106.

In the folded position, a device may be captured by either the engagement pocket 120 or the engagement lip 124. When engaged, the device may be propped up for use by the user.

Figure 5:
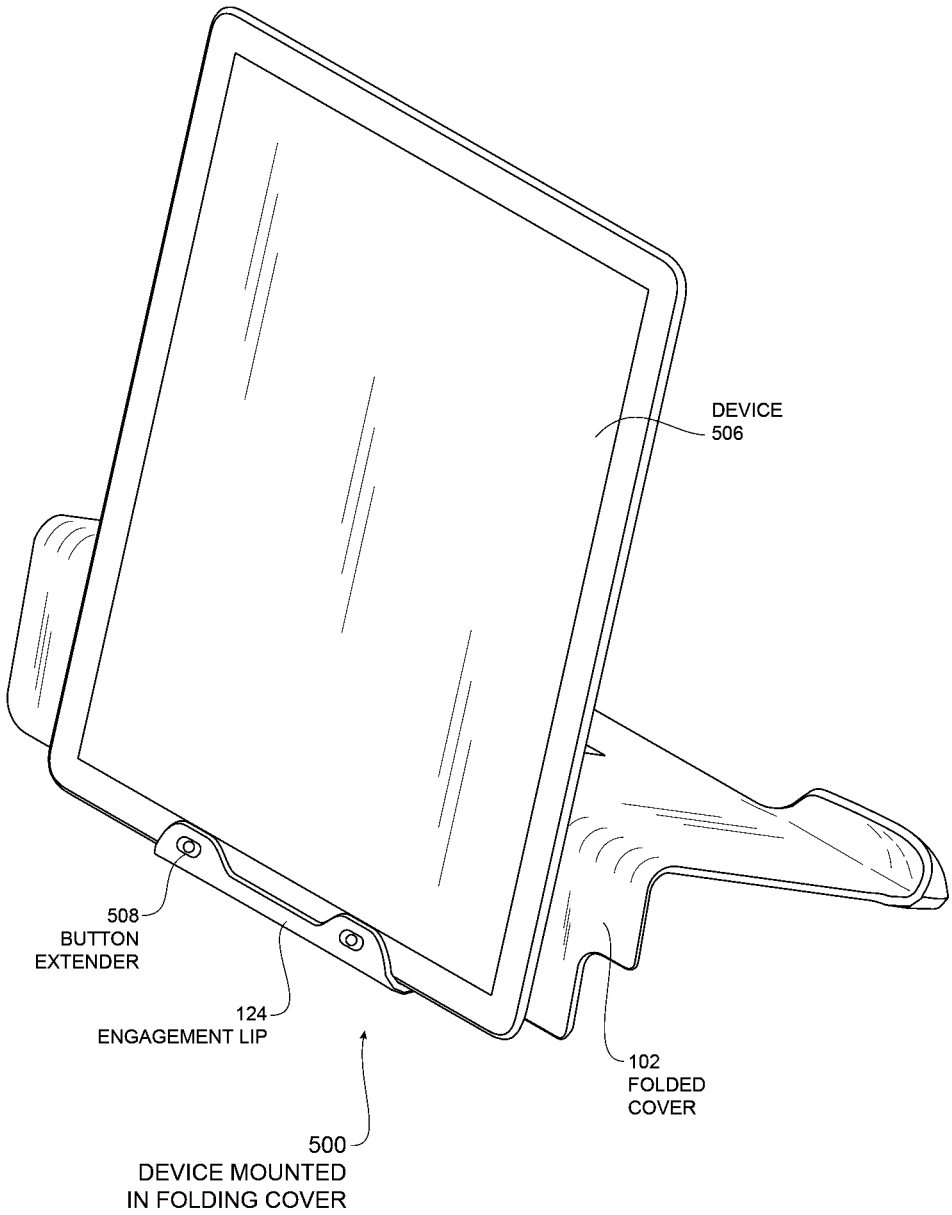
FIG. 5 is a perspective view of an embodiment of a folded protective cover shown holding a device.

FIG. 5 is an isometric illustration of an embodiment 500 showing a device supported by a folding cover.

The folding cover 102 is shown in a folded position and having an engagement lip 124. A device 506 is shown being captured by the engagement lip 124 and supported in a portrait orientation. The device 506 may be rotated such that it is in a landscape orientation while still being captured by the engagement lip 124.

In some embodiments, the engagement lip 124 may cover a button on the device 506. In such embodiments, a button extender 508 may be a flexible button molded into the engagement lip 124 that may have a tab that presses against a corresponding button on the device 506. The button extender 508 may allow a user to active the button on the device 506. Such button extenders may be incorporated into the bottom portion of the engagement lip 124 so that buttons on the side of the device 506 may be activated through the engagement lip. Other button extenders may be located on the folded cover 102 at various locations so that buttons on the device 506 may be actuated when the cover 102 is mounted on the device 506 in the protective position, use position, or other positions.

Figure 6:
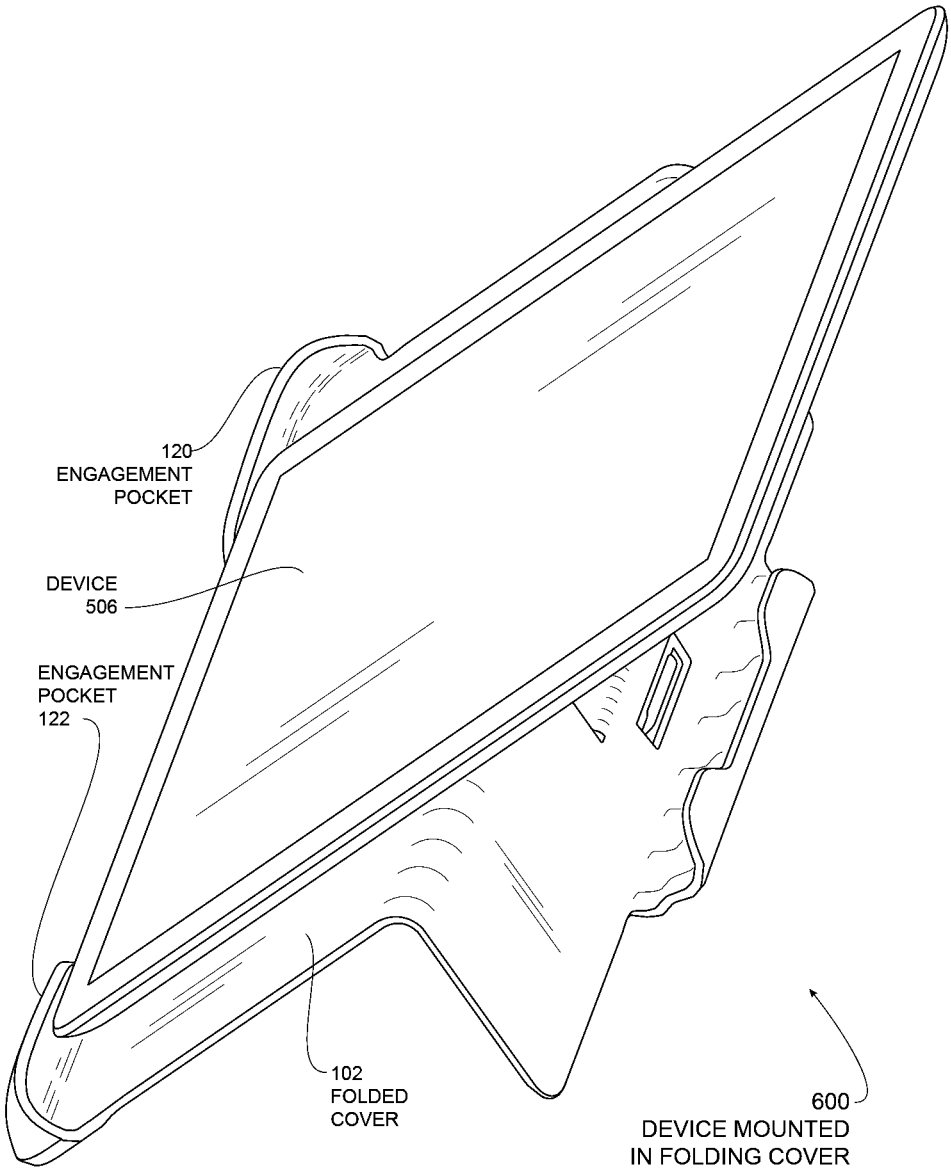
FIG. 6 is a perspective view of an embodiment of a folded protective cover shown holding a device in a second position.

FIG. 6 is an isometric illustration of an embodiment 600 showing a device supported by a folding cover.

The folding cover 102 is shown in a folded position and having an engagement pockets 122 and 120. A device 506 is shown being captured by the engagement pockets 122 and 120 and supported in a portrait orientation. The device 506 may be rotated such that it is in a landscape orientation while still being captured by the engagement pockets 122 and 120.

Embodiments 500 and 600 illustrate how a device may be supported by a folding cover when the cover is in the folded position.

Figure 7:
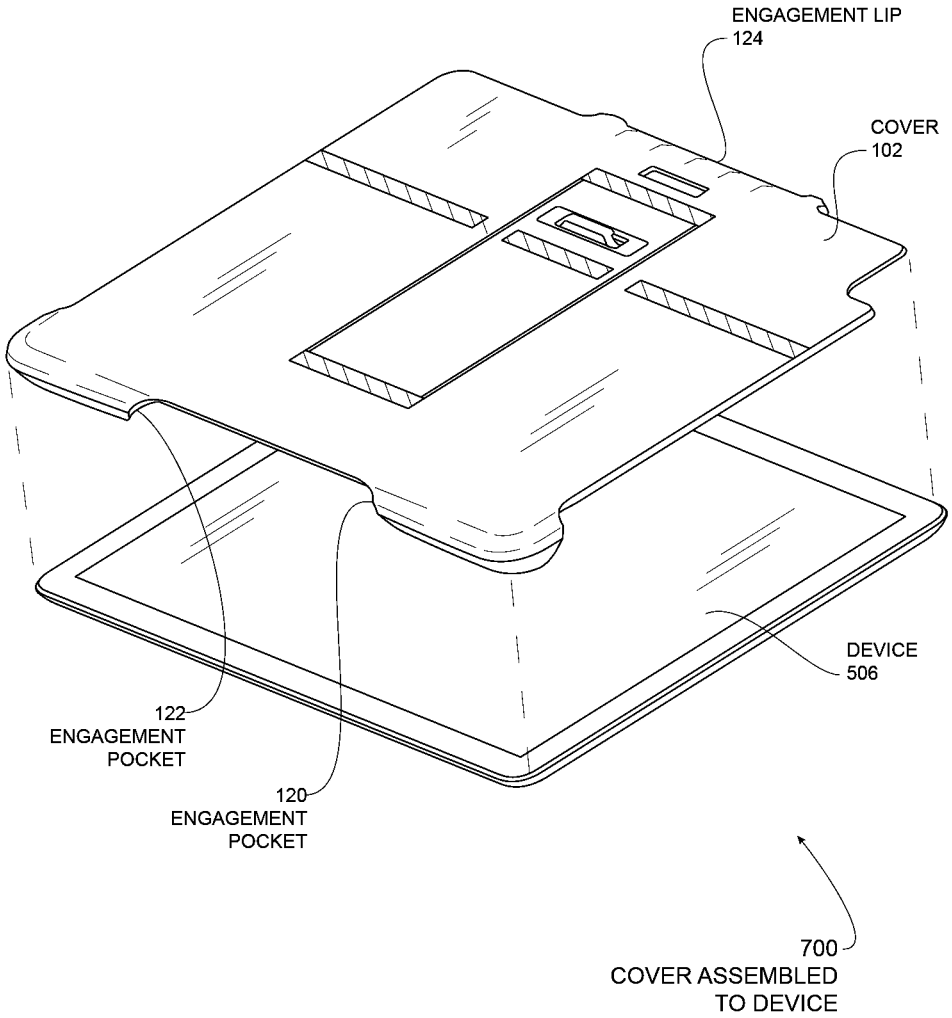
FIG. 7 is a perspective view of an embodiment of a protective case shown being attached to a device in the protective position.

FIG. 7 is an isometric illustration of an embodiment 700 showing a cover assembled to a device.

A folding cover 102 is illustrated in the flat configuration and having an engagement lip 124 and engagement pockets 120 and 122. The cover may be attached to the device 506.

Because the device 506 may be relatively flat and have a similar shape on the top and bottom, the folding cover 102 may be attached to the front side of the device to protect a touchscreen or other user interface, which may be a protective position. The folding cover 102 may also be attached to the back side of the device so that the folding cover 102 may be secured to the device 506 but the device 506 may be accessible and operable by a user.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A folding stand for an electronic device, the folding stand comprising:

a first component having a first engagement mechanism configured to capture a portion of said electronic device;

a second component having a second engagement mechanism configured to capture a portion of said electronic device, said second component being joined to said first component by a first hinge, wherein said first component is directly connected to said first hinge, and wherein said second component is directly connected to said first hinge;

a stringer comprising a first end and a second end opposite said first end, wherein said first end of said stringer is directly connected to said first component by a second hinge and said second end of said stringer is directly connected to a first end of a lock plate by a third hinge, wherein said lock plate comprises a second end opposite said first end of said lock plate, wherein said second end of said lock plate is directly connected to said second component by a fourth hinge, and wherein said lock plate comprises a locking feature that is directly and removably engageable to said second component;

said folding stand being configurable into a flat position for transportation of said electronic device wherein said first component and said second component are coplanar and wherein said locking feature of said lock plate is disengaged from said second component and wherein said first engagement mechanism and said second engagement mechanism are configured to capture said electronic device and hold said electronic device against a front surface of said first component and against a front surface of said second component when said folding stand is in said flat position;

said folding stand being configurable into a folded position to hold said electronic device for use, wherein said locking feature of said lock plate is directly engaged to said second component when said folding stand is in said folded position.

2. The folding stand of claim 1, wherein said first engagement mechanism comprises a first engagement pocket configured to capture a first corner of said electronic device and a second engagement pocket configured to capture a second corner of said electronic device, and wherein said second engagement mechanism comprises an engagement lip configured to capture an edge of said electronic device.

3. The folding stand of claim 2, said engagement lip comprising a button extender configured to engage a button on said electronic device.

4. The folding stand of claim 2, wherein said engagement lip is configured to capture said electronic device in a portrait orientation or a landscape orientation when said folding stand is in said folded position.

5. The folding stand of claim 2, wherein said first engagement pocket and said second engagement pocket are configured to capture said electronic device in a portrait orientation or a landscape orientation when said folding stand is in said folded position.

6. The folding stand of claim 2, wherein said engagement pockets are flexible features that comprise thermoplastic polymerized rubber.

7. The folding stand of claim 1, said first and second components being formed in a first molding process and said first hinge being formed from a thermoplastic elastomer in a secondary molding process to join said first component to said second component.

8. The folding stand of claim 7, said second hinge being formed from said thermoplastic elastomer in said secondary molding process.

9. The folding stand of claim 8, said third hinge and said fourth hinge being formed from said thermoplastic elastomer in said secondary molding process.

10. The folding stand of claim 9, said locking feature comprising a hook configured to attach to a receiver disposed in said second component when said folding stand is in said folded position.

11. The folding stand of claim 9, said first engagement mechanism being formed from said thermoplastic elastomer.

12. The folding stand of claim 1, when said folding stand is in said folded position: said folding stand being configured to support said electronic device against said first component and said folding stand being configured to capture said electronic device with said first engagement mechanism in a landscape orientation.

13. The folding stand of claim 1, when said folding stand is in said folded position: said folding stand being configured to support said electronic device against said second component and said folding stand being configured to capture said electronic device with said second engagement mechanism in a portrait orientation.

14. The folding stand of claim 1, wherein said folding stand is configured to receive a touchscreen of said electronic device against said front surface of said first component and against said front surface of said second component when said folding stand is in said flat position, wherein said folding stand is configured to serve as a cover for said touchscreen of said electronic device when said folding stand is in said flat position.

15. The folding stand of claim 1, wherein said folding stand is configured to receive a back surface of said electronic device against said front surface of said first component and against said front surface of said second component when said folding stand is in said flat position, and wherein, in said flat position, said folding stand is configured such that a touchscreen of said electronic device is accessible.

16. The folding stand of claim 1, wherein a centerline of said first hinge is coaxial with a centerline of said third hinge when said folding stand is in said flat position.

17. The folding stand of claim 16, wherein said centerline of said first hinge is parallel and offset from said centerline of said third hinge when said folding stand is in said folded position.

18. The folding stand of claim 17, when said folding stand is in said folded position: said folding stand provides a first supported angle for said electronic device and a second supported angle for said electronic device, wherein said first component is configured to support said electronic device and wherein said first engagement mechanism is configured to capture said electronic device when said electronic device is supported at said first supported angle, and wherein said second component is configured to support said electronic device and wherein said second engagement mechanism is configured to capture said electronic device when said electronic device is supported at said second supported angle.

19. The folding stand of claim 1, wherein said locking feature of said lock plate is a hook portion engageable to a loop portion on said second component.

20. The folding stand of claim 1, wherein said locking feature of said lock plate is a loop portion engageable to a hook portion on said second component.

* * * * *